US008302640B2

(12) United States Patent
Molina et al.

(10) Patent No.: US 8,302,640 B2
(45) Date of Patent: Nov. 6, 2012

(54) MEDICAL VIAL CAPTURE AND RETENTION SYSTEM AND METHOD

(75) Inventors: Carlos Molina, Venice, CA (US); Michael Joseph Brang, Simi Valley, CA (US)

(73) Assignee: Safe-T-Med, LLC, Venice, CA (US)

( * ) Notice: Subject to any disclaimer, the term of this patent is extended or adjusted under 35 U.S.C. 154(b) by 0 days.

(21) Appl. No.: 13/346,046

(22) Filed: Jan. 9, 2012

(65) Prior Publication Data

US 2012/0103464 A1 May 3, 2012

(51) Int. Cl.
*B65B 1/04* (2006.01)

(52) U.S. Cl. ..... 141/319; 248/311.3; 248/313

(58) Field of Classification Search ..... 141/27, 141/1, 165, 319; 248/103, 104, 311.2, 311.3; 294/87.24, 86.31; 198/803.7, 803.9
See application file for complete search history.

(56) References Cited

U.S. PATENT DOCUMENTS

| | | | | |
|---|---|---|---|---|
| 2,677,372 | A * | 5/1954 | Barnish, Jr. | 604/414 |
| 3,125,369 | A * | 3/1964 | Copping | 294/87.24 |
| 3,314,635 | A * | 4/1967 | Frye | 248/311.2 |
| 3,982,716 | A | 9/1976 | Trees | |
| 4,005,844 | A | 2/1977 | Richmond | |
| 4,036,353 | A * | 7/1977 | Suter | 198/803.9 |
| 4,278,225 | A | 7/1981 | Phelps | |
| 5,704,495 | A | 1/1998 | Bale et al. | |
| 5,975,470 | A | 11/1999 | Casey | |
| 6,070,761 | A * | 6/2000 | Bloom et al. | 222/81 |
| 6,079,541 | A * | 6/2000 | Bercelli et al. | 198/377.03 |
| 6,156,275 | A | 12/2000 | Dumitrescu et al. | |
| 6,250,592 | B1 * | 6/2001 | Davis | 248/104 |
| 6,345,723 | B1 | 2/2002 | Blake et al. | |
| 6,497,697 | B1 | 12/2002 | Cohn | |
| 7,178,777 | B1 * | 2/2007 | Banker | 248/316.7 |
| 7,207,434 | B2 * | 4/2007 | Hartness et al. | 198/803.7 |
| 7,418,981 | B2 * | 9/2008 | Baker et al. | 141/9 |
| 2009/0099543 | A1 | 4/2009 | Stein | |

* cited by examiner

*Primary Examiner* — Timothy L Maust
(74) *Attorney, Agent, or Firm* — Lance M. Pritikin, Esq.

(57) ABSTRACT

A system and method is provided for capturing and releasably retaining one or more vials of medication in an at least partially inverted orientation. Embodiments include a housing partially defining one or more vial engagement stations. Each station includes a clamp element and a latch element which, upon insertion of a vial into the respective station, cooperate to capture and releasably retain the vial. A handle portion may be provided by which the clamp element may be returned to and latched in its open configuration, thereby also releasing the vial from the respective station. Each station may accommodate vials of various diameters. The housing may be mountable to a pole stand in vertically-adjustable fashion. The system may allow the vials to be retained at an angle with respect to the stand or local horizontal surface. Embodiments may further comprise a tray support bracket and removable drip tray element.

24 Claims, 5 Drawing Sheets

MEDICAL VIAL CAPTURE AND RETENTION SYSTEM AND METHOD

TECHNICAL FIELD

The present invention relates generally to systems and methods for retaining medical vials. More particularly, the invention relates to a system and method for releasably retaining medical vials in at least partially inverted orientation for extraction of medication therefrom.

BACKGROUND

One of the more common methods of dispensing injectable medications in the sterile environment of a procedure or operating room is to have an assistant manually holding the vial of medication while a medical professional extracts the medication from the vial using a syringe. This conventional method poses several inherent dangers to the patient receiving the medication as well as the health care professionals and assistants involved in administering it. First, the professional must approach the assistant with the syringe, and must place the needle into the vial of medication while maintaining sterility. This introduces the potential for the assistant to suffer a needle stick injury, possibly resulting in associated infection. Second, an assistant approaching the sterile field with the vial of medication is typically themselves non-sterile. This increases the possibility that the sterile field will become inadvertently contaminated. Third, a medication vial being held by the assistant is typically not directly visually accessible to the professional, thus the professional is commonly forced to rely upon the assistant to verify that the vial contains the correct medication. This increases the chance that an incorrect medication will be drawn into the syringe, placing a patient at further significant risk.

When a medical professional is acting alone in preparing an injection, they must hold the medicine vial with one hand and direct the exposed needle into the vial with the other hand. This poses a threat to the professional since the needle is being aimed at a portion of their body.

What is needed is a system and method allowing the capture and retention of one or more vials of medication in which the tops of the vials remain exposed for puncturing by a syringe and extraction of the medication. Such systems and methods should allow the medical professional to verify which medications are being drawn into respective syringes from each retained vial. Since medical procedures are performed at a variety of heights, depending upon variations in the operating theater and the physical stature of the practitioner, such a system would preferably be rapidly adjustable in the vertical direction.

SUMMARY

Certain deficiencies of the prior art may be overcome by the provision of a system for capturing and releasably retaining one or more vials of medication in an at least partially inverted orientation wherein the top of each vial remains accessible to a syringe needle.

The system comprises a housing which partially defines one or more vial engagement stations. Each station is configured to receive a vial such that the vial is retained in an orientation which is at least partially inverted. Each station is typically designed to accommodate vials of varying diameters.

Each station generally includes a clamp element and a latch element. The clamp element may include a handle portion extending generally outward of the housing. The clamp element is typically connected to the housing for movement between an open configuration and a clamping configuration, and is elastically biased toward its clamping configuration. The clamp element is typically movable from its clamping configuration to its open configuration by way of a reset force applied to its handle portion. The latch element is movable between a latching configuration and an unlatching configuration, and is resiliently biased toward its latching configuration. The latch element typically includes a distal portion and is able to be actuated toward its unlatching configuration by way of an actuation force applied to the distal portion by way of, for example, a vial being inserted into the respective station.

The clamp element is generally adapted to apply a clamping force to a respective vial when in its clamping configuration, and to relieve the clamping force when moved toward its open configuration. The latch element is typically adapted to latchingly restrain the clamp element in its open configuration upon movement of the clamp element thereto. The latch element is generally adapted to allowing the clamp element to move from its open configuration toward its clamping configuration when the latch element is actuated to its unlatching configuration.

The system may include a drip tray and a tray support bracket. The drip tray may be removably supportable by the tray support bracket, and the tray support bracket may be vertically adjustably mountable to the same stand element as the housing.

The housing may include a window corresponding to each station. The window allows a vial label to be viewable from outside the housing when the respective vial is retained by the respective station, thus providing direct visual access to the name of the medication, concentration and expiration date. The housing element typically includes a mounting portion adapted to allow the housing to be secured to a stand, such as a conventional mobile or drip stand, and to allow the vertical position of the system to be conveniently and rapidly adjusted. The stations are typically adapted such that vials captured and retained therein are maintained at an angle with respect to the stand on which the system is mounted, or with respect to the local horizontal surface. This angle may be, for example, between approximately 5 and 25 degrees.

Operation of a system as described and claimed herein decreases the chances of accidental needle-stick injuries by eliminating the need for an assistant to physically hold the medication being drawn. The system does not require the involvement of a second person who can potentially interfere with the sterile field, and the medical professional does not have to rely on another person to correctly identify the medication, concentration, and expiration date of the medication.

BRIEF DESCRIPTION OF THE DRAWINGS

Further advantages of the present invention may become apparent to those skilled in the art with the benefit of the following detailed description of the preferred embodiments and upon reference to the accompanying drawings in which.

DETAILED DESCRIPTION OF THE PREFERRED EMBODIMENTS

Figure 1:
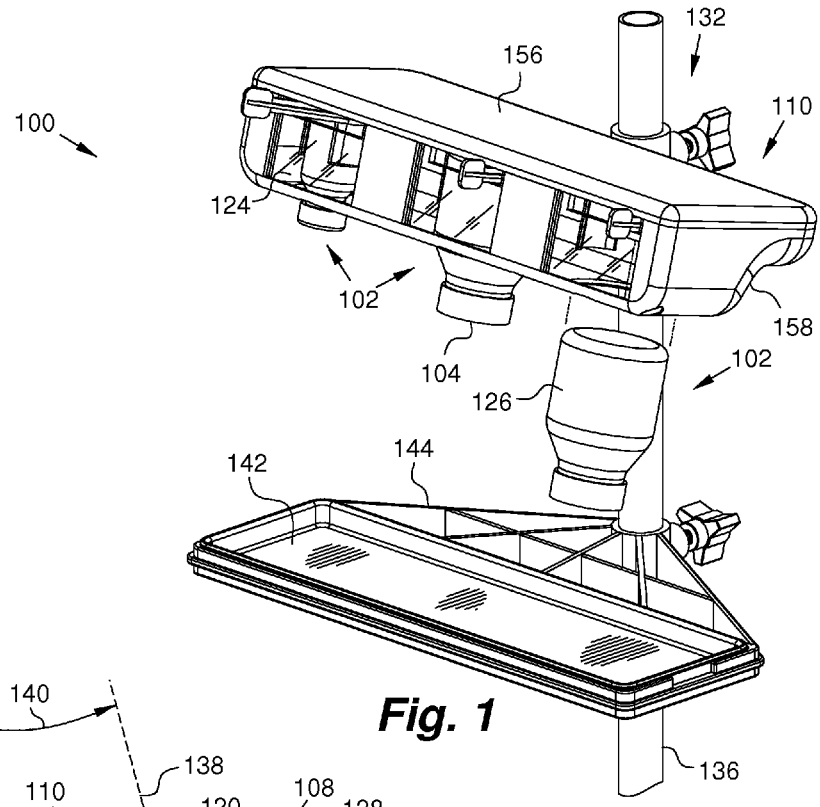
FIG. 1 is a diagrammatic perspective view of one example embodiment of a system for capturing and releasably retaining medical vials in accordance with the present invention.
Figure 2:
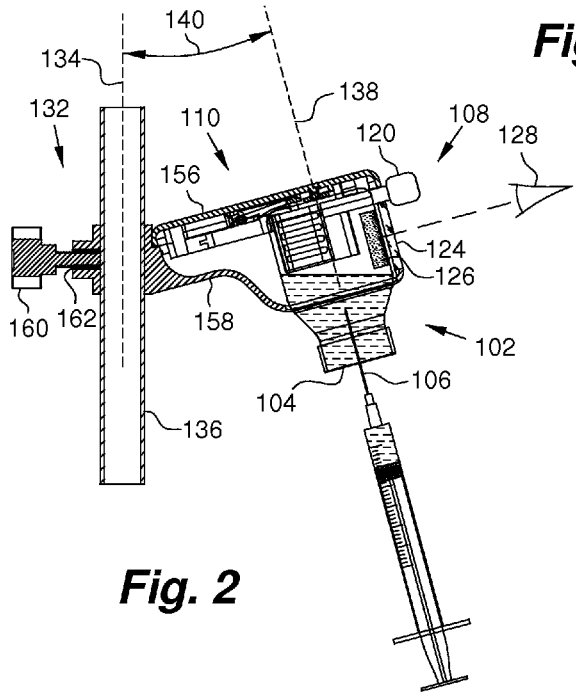
FIG. 2 is a diagrammatic cross-sectional partial view of the system shown in FIG. 1.

Referring now to the drawings, like reference numerals designate identical or corresponding features throughout the several views. Referring to FIGS. 1 and 2, shown generally at 100 is one particular embodiment of a system adapted for capturing and releasably retaining at least one vial 102 of medication in an at least partially inverted orientation wherein the top 104 of each vial 102 remains accessible to a syringe needle 106. The top 104 of a typical such vial 102 generally defines, at least in part, a portion or membrane puncturable by a needle 106.

Figure 5:
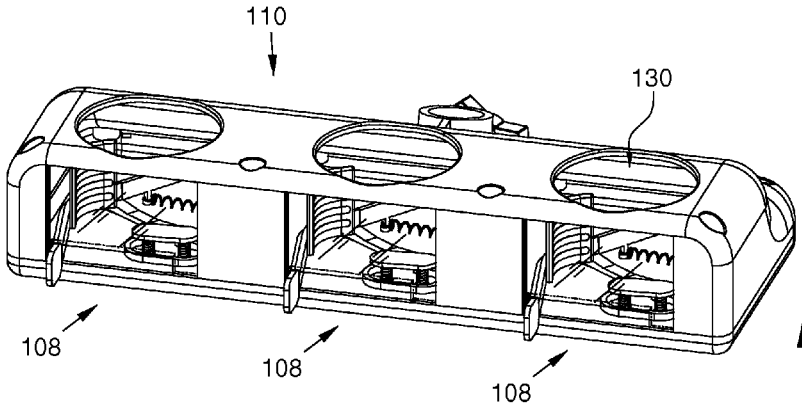
FIG. 5 is a diagrammatic assembled view of the upper portion shown in FIG. 3.
Figure 6:
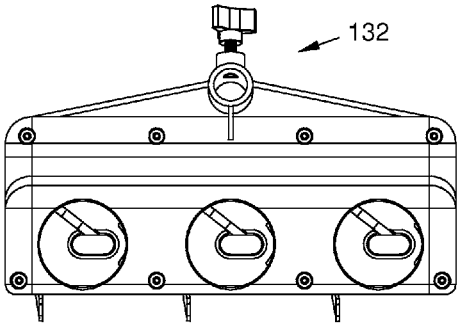
FIG. 6 is a diagrammatic bottom view of the upper portion shown in FIG. 5, wherein the vial engagement stations are devoid of respective vials and the clamp elements are in their open configurations.

Referring to FIG. 5, a system 100 may comprise one or more vial engagement stations 108. Each vial engagement station 108 may, for example, be at least partially defined by a housing element 110. In certain preferred embodiments having a multiplicity of vial engagement stations 108, the stations may be partially defined by the same housing element 110. Referring to FIG. 1, in particular embodiments, a housing element 110 may be comprised of a base portion 156 and an enclosure portion 158. Such housing portions may be substantially made of, for example, a polymer, and may be secured to one another by way of, for example, self-tapping screws (not shown) which may engaging boss portions 174, or by way of adhesive, ultrasonic weld, or similar conventional joining or securement means.

Figure 3:
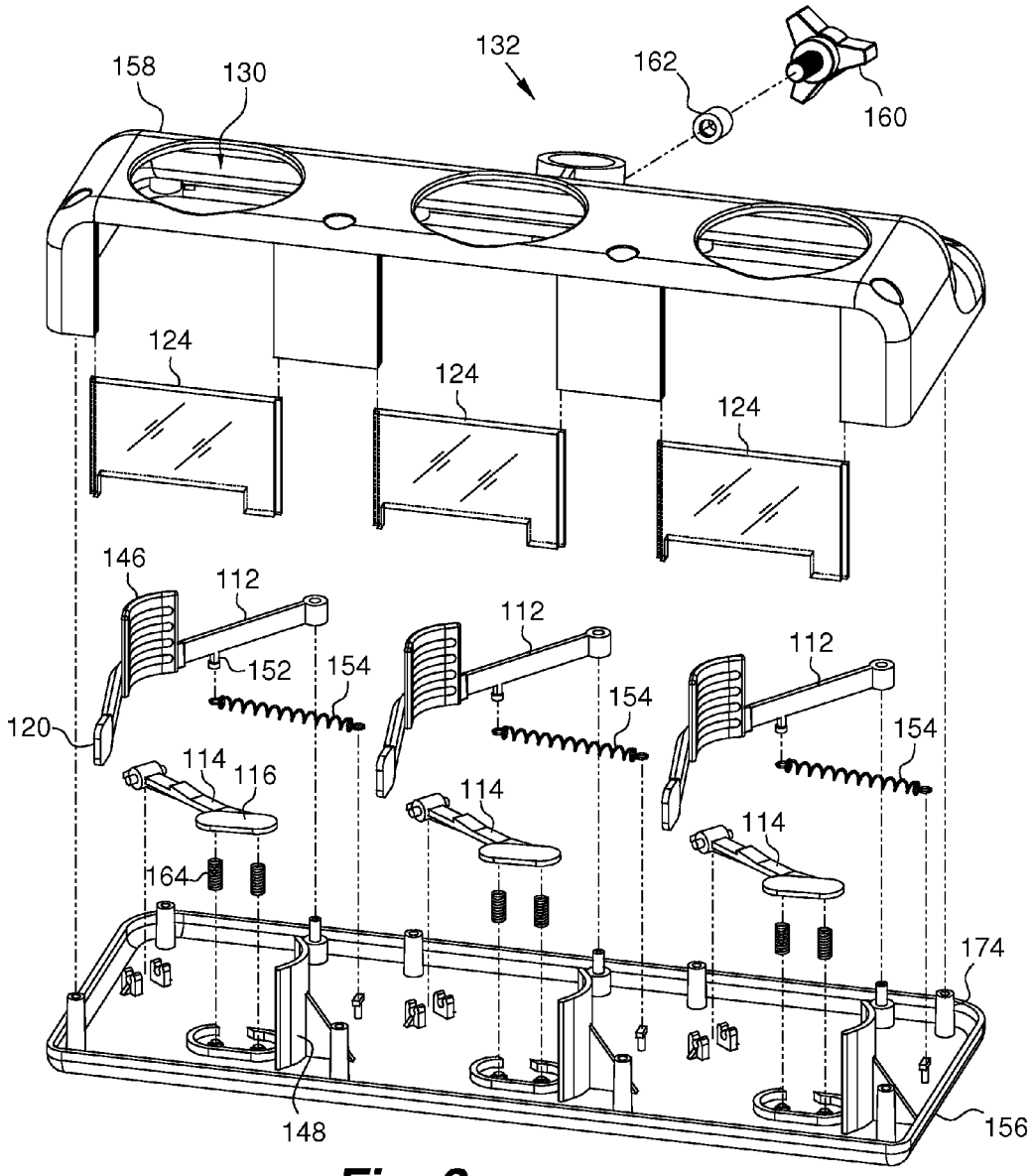
FIG. 3 is a diagrammatic exploded view of the upper portion of the embodiment shown in FIG. 1.
Figure 4:
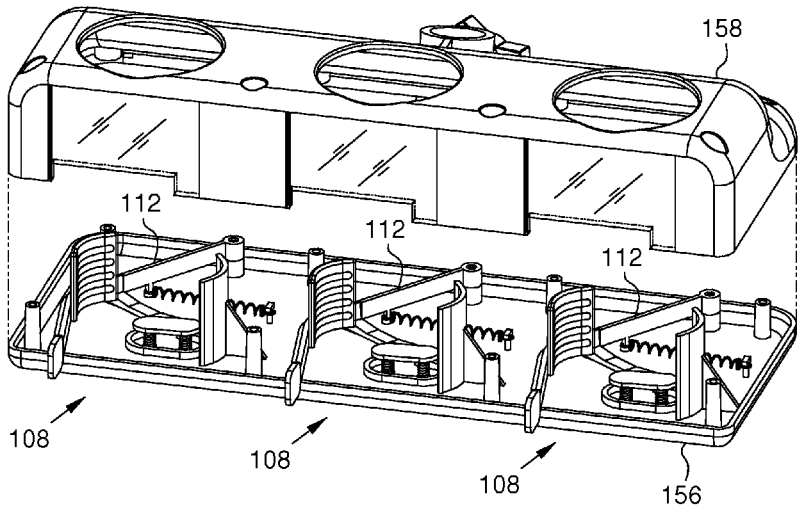
FIG. 4 is a diagrammatic partially assembled view of the upper portion shown in FIG. 3.

Referring to FIG. 3, a vial engagement station 108 may include a clamp element 112 and a latch element 114. A station 108 may be adapted to receive a vial 102 for releasable retention thereof in an at least partially inverted orientation (see, for example, FIG. 2). Each station 108 is typically designed to accommodate vials 102 of varying diameters. A clamp element 112 may be pivotably associated with the housing element 110 for movement between an open configuration (as illustrated, for example, in FIG. 8) and a clamping configuration (as illustrated, for example, in FIG. 10). A clamp element 112 may be elastically biased toward its clamping configuration by way of, for example, a clamp spring element 154 or the like. A latch element 114 may be movable between a latching configuration (as illustrated, for example, in FIG. 8) and an unlatching configuration (as illustrated, for example, in FIG. 9). A latch element 114 may be resiliently biased toward its latching configuration by way of, for example, one or more latch spring elements 164, or the like.

Figure 7:
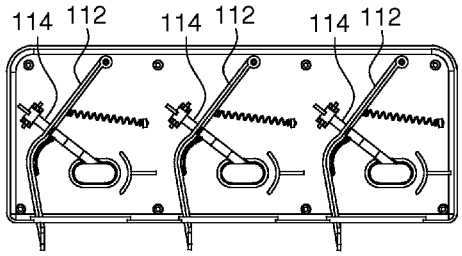
FIG. 7 is a diagrammatic bottom view identical to that of FIG. 6, but in which the enclosure portion of the housing element is removed.
Figure 15:
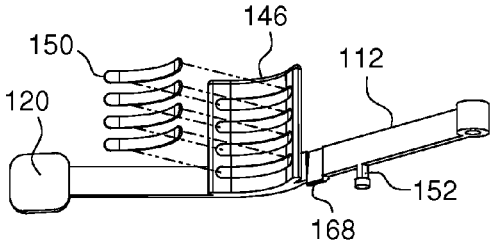
FIG. 15 is a diagrammatic perspective view of one example of a clamp element with a generally curved clamp wall, showing a multiplicity of elastomeric gripping elements exploded therefrom.
Figure 16:
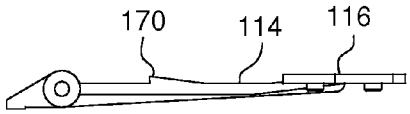
FIG. 16 is a diagrammatic side view of one example of a latch element.
Figure 17:
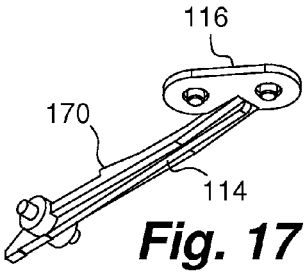
FIG. 17 is a diagrammatic perspective view of the latch element of FIG. 16.

In preferred embodiments, the clamp element 112 may be adapted to applying a clamping force (see, for example, 166 in FIG. 11) to a vial 102 when in its clamping configuration, and relieving the clamping force when moved toward its open configuration. Referring to FIG. 7, for example, in preferred embodiments, the latch element 114 may be adapted to latchingly restrain the clamp element 112 in the open configuration when the latch element 114 is in its latching configuration. In such embodiments, the latch element 114 is typically adapted to allowing the clamp element 112 to move from the open configuration toward the clamping configuration when the latch element 114 is in its unlatching configuration. Referring to FIGS. 15 and 16, the latching restrainment may be achieved, for example, by engagement between a latch engagement portion 168 on the clamp element 112 and a clamp engagement portion 170 on the respective latch element 114. Such an embodiment may allow the latch element 114 to automatically latch the clamp element 112 in its open configuration merely upon movement of the clamp element 112 to its open configuration.

Figure 9:
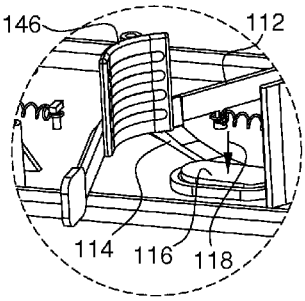
FIG. 9 is a diagrammatic partial view of an embodiment similar to that of FIG. 8, but in which the latch element is in its unlatching configuration.
Figure 10:
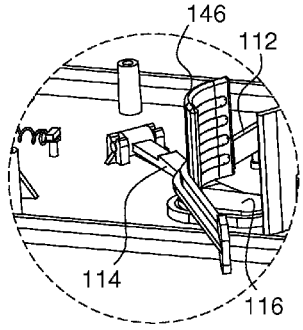
FIG. 10 is a diagrammatic partial view of an embodiment similar to that of FIG. 8, but in which the latch element is in its unlatching configuration and the clamping element has moved to a clamping configuration.

In certain embodiments, each latch element 114 may include a distal portion 116 and be actuatable toward its unlatching configuration by way of an actuation force (see, for example, 118 in FIG. 9). The actuation force 118 may be applied to the distal portion 116 by way of, for example, a vial 102 being inserted into the respective vial engagement station 108.

In particular embodiments, each clamp element 112 may include a handle portion 120 accessible from outward of the housing element 110. In such embodiments, the clamp element 112 may be movable from its clamping configuration to its open configuration by way of a reset force (see, for example, 122 in FIG. 8) applied to its handle portion 120. In certain such embodiments, such as those shown throughout the several FIGS., the handle element 120 may itself project outwardly of the housing element 110. Referring to FIG. 15, clamp elements 112 may include one or more elastomeric gripping elements 150 thereon.

Figure 18:
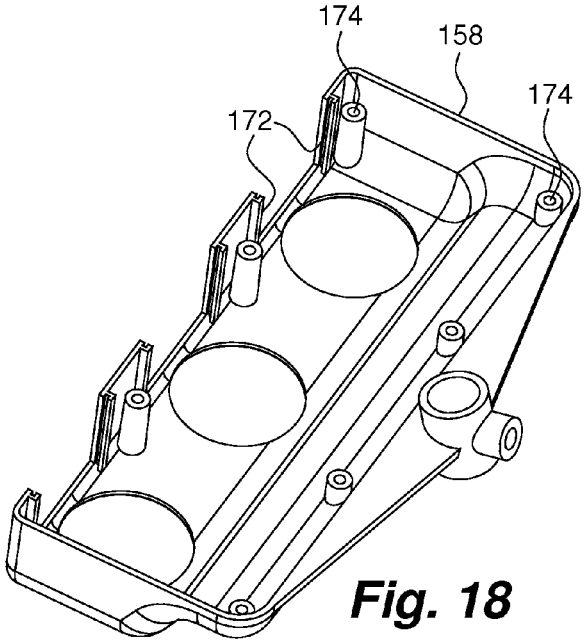
FIG. 18 is a diagrammatic perspective view of an enclosure portion of one example of a housing element.

Referring in particular to FIGS. 1 and 2, in certain embodiments, the housing element 110 may include at least one window portion 124 through which a label 126 of a vial 102 is able to be read from a viewing position 128 outward of the housing element 110 when the respective vial 102 is in releasable retention in a vial engagement station 108. In such embodiments, the window portions 124 may be adapted to slidably engagement window engagement grooves 172 within one or more portions of the housing element 110, such as, for example, the enclosure portion 158 shown in FIG. 18.

Referring to FIG. 5, in particular embodiments, each vial engagement station 108 may include a vial receiving aperture 130 extending at least partially through the housing element 110. As illustrated in FIG. 1, such vial receiving apertures 130 may be adapted to receive a respective vial 102 therein such that the top 104 of the vial 102 extends outward of the housing element 110 when the vial 102 is in releasable retention. In particular such embodiments, a vial receiving aperture 130 may include a flexible vial engagement flap or skirt to aid in securing a vial 102 in releasable retention by the station 108.

Referring to FIG. 2, in certain embodiments the housing element 110 may include a mounting portion 132 with a mounting axis 134. The mounting portion 132 may be for vertically adjustable mounting of the housing element 110 to an elongated substantially vertical stand element (an example of which is illustrated at 136) such that the mounting axis 134 is generally parallel to the stand element 136. Such a mounting portion 132 may include, for example, a threaded knob 160 and threaded insert 162 which may cooperate to secure the housing element 110 to the stand element 136 at a selected height. Alternatively or in addition, a mounting portion 132 may employ other conventional securement means such as alternative clamp systems, ball plunger systems, and the like.

Returning to FIG. 2, the at least partially inverted orientation of vials 102 may be defined along a vial engagement axis 138. In particular embodiments, the vial engagement axis 138 may be at an orientation angle 140 of greater than 0 degrees with respect to the mounting axis 134. In certain such preferred embodiments, the orientation angle 140 is approximately between 5 degrees and 25 degrees. In one specific preferred embodiment, the orientation angle 140 is approximately 15 degrees.

In certain embodiments, the orientation angle 140 may be readily adjustable. In such an embodiment, for example, the mounting portion 132 may be in pivotable engagement with the remainder of housing element 110. In operation of such an embodiment, once the preferred orientation angle 140 is achieved, the pivotability may be locked by, for example, a conventional tilt lock element, or hindered by a frictional interface between the mounting portion 132 and the remainder of the housing element 110.

Figure 14:
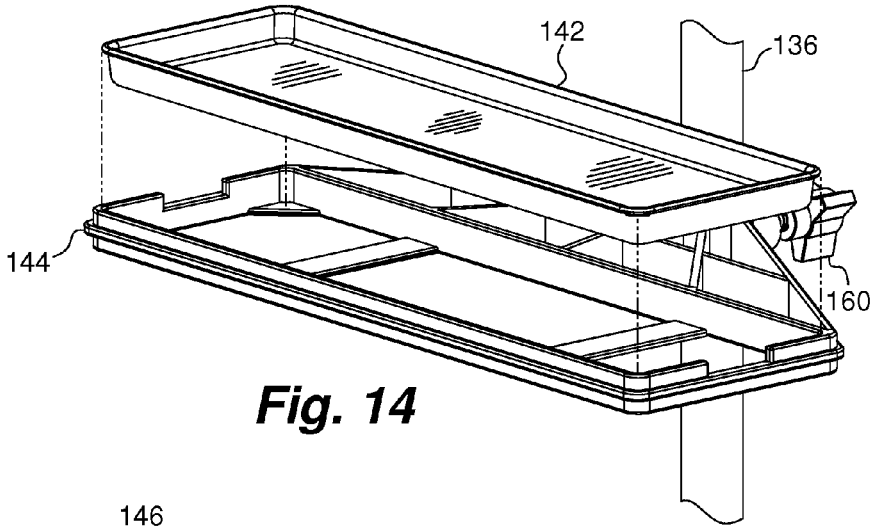
FIG. 14 is a diagrammatic perspective view of a drip tray and a tray support bracket, in which the tray support bracket is shown vertically adjustably mounted to a stand element and the drip tray is removed from the tray support bracket.

Returning to FIG. 1, particular embodiments of a system 100 may comprise a drip tray 142 and a tray support bracket 144. As illustrated in FIG. 14, the drip tray 142 may be removably supportable by the tray support bracket 144. Such an arrangement may allow the drip tray 142 to be covered with a disposable liner which, for example, may wrap at least partially around its perimeter edge, and replaced onto the tray support bracket 144 to help temporarily secure the liner in place. Moreover, a removable tray 142 may allow a pre-prepared collection of medical vials 102 and syringes to be carried from a location outside of a treatment room directly to the vial retention system 100 within the treatment room.

Figure 11:
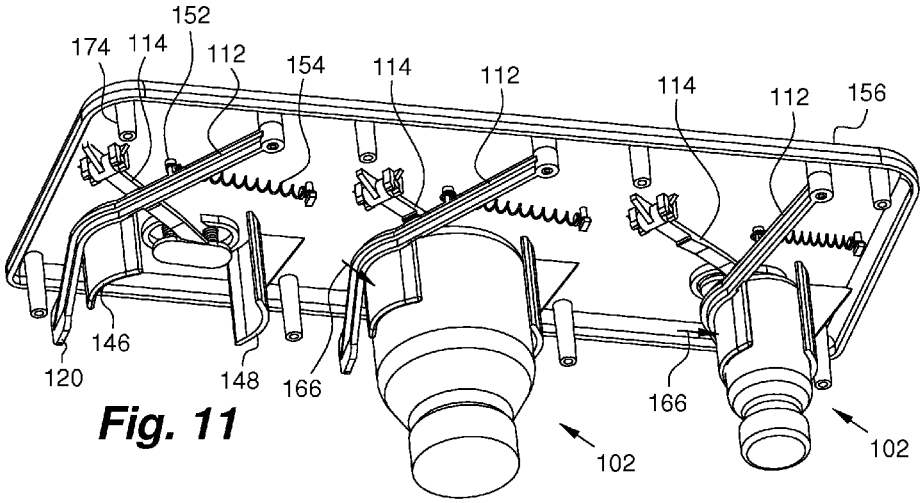
FIG. 11 is a diagrammatic perspective view of an embodiment with a portion of its housing removed, in which vials of two different diameters are shown held in releasable retention by respective vial engagement stations.
Figure 12:
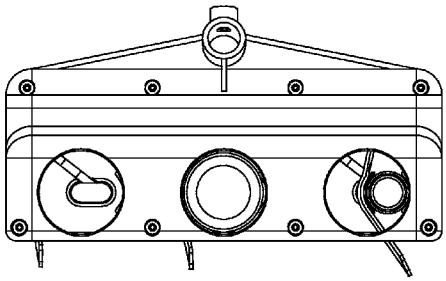
FIG. 12 is a diagrammatic bottom view of the embodiment shown in FIG. 11, but with the enclosure portion of its housing element replaced.
Figure 13:
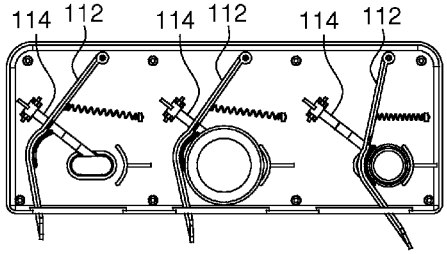
FIG. 13 is a diagrammatic bottom view of the embodiment shown in FIG. 11, illustrating the clamp element of one vial engagement station being in its open configuration, and the clamp elements of the other two vial engagement stations being in respective clamping configurations.

Referring to FIG. 11, in certain embodiments, the clamp elements 112 may include a generally curved clamp wall 146 and the housing element 110 may include a generally curved fixed wall 148. In such embodiments, the clamp wall 146 and fixed wall 148 may each have a respective axis of curvature which is substantially parallel to the vial engagement axis 138. Such a feature may help align vial 102 into proper orientation upon capture of the vial 102 by the vial engagement station 108, without relying on the user to ensure such alignment upon insertion of the vial 102. Alternative embodiment may have either a curved clamp wall 146 or a curved fixed wall 148. In yet further embodiments, the clamp wall 146 or fixed wall 148 may be substantially flat planar.

Figure 8:
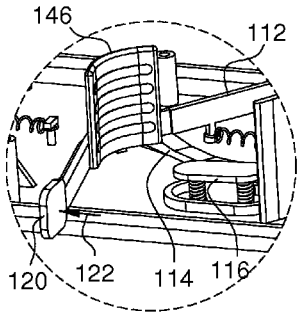
FIG. 8 is a diagrammatic partial view of an embodiment of a vial engagement station, showing a clamp element in its open configuration and the respective latch element is in its latching configuration.

Referring to FIG. 15, in particular embodiments, a clamp wall 146 may be disposed generally between a spring engagement portion 152 and a handle portion 120. Referring to FIG. 11, in such embodiments, the elastic bias may be provided by a clamp spring element 154 connected between the spring engagement portion 152 and, for example, the housing element 110. Referring to FIGS. 8 and 11, the resulting leverage may allow the clamp element 112 to produce a higher clamping force 166 while comparatively reducing the reset force 122 required to be applied to the handle portion 120 in order to move the clamp element 112 back toward its open configuration.

Certain embodiments of a system 100 as described herein may do without, for example, a latch element 114. In such an embodiment, an operator of the system may manually hold the respective clamp element 112 in its open configuration while inserting the vial into the vial engagement station 108, and then release the clamp element 102 to releasably retain the vial 102 in its at least partially inverted orientation. Similarly, once the medication has been extracted from the vial 102, the operator could move the clamp element 112 toward its open configuration and hold it there manually to allow the vial 102 to be removed from the vial engagement stations 108.

Embodiments of a method for using at least one syringe to extract medication from at least one vial without requiring a human hand to grasp the vial or vials during the extraction are described below.

Embodiments of a method may comprise providing a vial engagement station 108 partially defined by a housing element 110. The vial engagement station 108 may include a clamp element 112 and a latch element 114. The clamp element 112 may include a handle portion 120, and may be pivotably associated with the housing element 110 for movement between an open configuration and a clamping configuration. The clamp element 112 may be elastically biased toward its clamping configuration. The latch element 114 may be movable between a latching configuration and an unlatching configuration, and may be resiliently biased toward its latching configuration. The latch element 114 may include a distal portion 116 and be actuatable toward its unlatching configuration by way of an actuation force 118 applied to the distal portion 116. The latch element 114 may be adapted to latchingly restrain the clamp element 112 in the open configuration when the latch element 114 is in its latching configuration. The latch element 114 may be adapted to allowing the clamp element 112 to move from the open configuration toward the clamping configuration when the latch element is in its unlatching configuration.

Embodiments of a method may further comprise choosing a vial 102 containing a selected medication, transporting the vial 102 to the vial engagement station 108, at least partially inverting the vial 102, and upwardly inserting the vial into the vial engagement station 108. The step of inserting the vial 102 may result in the vial 102 applying the actuation force 118, resulting in movement of the clamp element 114 to its clamping configuration wherein it applies a clamping force 166 to the vial. Thus, the vial engagement station 108 may thereby releasably retain the vial in an at least partially inverted orientation wherein the top 104 of the vial 102 remains accessible to a syringe needle 106 of the syringe.

Embodiments of a method may further comprise reading a label 126 of the vial 102 from a viewing position 128 outward of the housing element 110 to verify the vial 102 contains the selected medication. The top 104 of the vial 102 may be punctured with the syringe needle 106, at least a volume of the selected medication extracting into the syringe, and the syringe needle 106 removed from the vial 102. A reset force 122 may then be applied to the handle portion 120, thereby causing the clamp element 112 to move to its open configuration such that the latch element 114 latches the clamp element 112 in its open configuration. This may release the vial 102 fall or be removed from the vial engagement station 108 for safe disposal or relocation of the vials 102.

In particular embodiments of a method as described herein, the housing element 110 may include a window portion 124 disposed between the label 126 of a vial 102 and the viewing position 128. Certain embodiments of a method may involve providing a multiplicity of vial engagement stations 108, respective vials 102 and respective syringes. In which embodiments, the vial engagement stations 108 may be partially defined by the same said housing element 110, and the steps of choosing, transporting, at least partially inverting, upwardly inserting and reading may be performed for each respective vial 102.

In certain embodiments of a method as described herein, the at least partially inverted orientation may be defined along a vial engagement axis 138. The vial engagement axis 138 may be at an orientation angle 140 of greater than 0 degrees with respect a local horizontal surface (such as the floor of a treatment or operating room, for example). In specific preferred embodiments the orientation angle 140 may be between 5 degrees and 25 degrees.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A system adapted for capturing and releasably retaining at least one vial of medication in an at least partially inverted orientation wherein the top of said at least one vial remains accessible to a syringe needle, said system comprising:

at least one vial engagement station partially defined by a housing element, said vial engagement station including a clamp element and a latch element and being adapted to receive a vial for releasable retention thereof in said at least partially inverted orientation, said clamp element being pivotably associated with said housing element for movement between an open configuration and a clamping configuration and being elastically biased toward its clamping configuration, said latch element being movable between a latching configuration and an unlatching configuration and being resiliently biased toward its latching configuration;

wherein said clamp element is adapted to applying a clamping force to said vial when in its clamping configuration, and relieving said clamping force when moved toward its open configuration; and wherein said latch element is adapted to latchingly restrain said clamp element in said open configuration when said latch element is in its latching configuration, and said latch element is adapted to allowing said clamp element to move from said open configuration toward said clamping configuration when said latch element is in its unlatching configuration.

2. A system as defined in claim 1 in which said latch element includes a distal portion and is actuatable toward its unlatching configuration by way of an actuation force applied to said distal portion by way of said vial.

3. A system as defined in claim 1 in which said clamp element includes a handle portion accessible from outward of said housing element, said clamp element being movable from its clamping configuration to its open configuration by way of a reset force applied to its handle portion.

4. A system as defined in claim 1 comprising a multiplicity of said vial engagement stations, all of which are partially defined by the same said housing element.

5. A system as defined in claim 1 in which said housing element includes at least one window portion through which a label of said vial is able to be read from a viewing position outward of said housing element when said vial is in said releasable retention.

6. A system as defined in claim 1 in which each said vial engagement station includes a vial receiving aperture extending at least partially through said housing element, said vial receiving aperture being adapted to receive said vial therein such that the top of said vial extends outward of said housing element when said vial is in said releasable retention.

7. A system as defined in claim 1 in which said housing element includes a mounting portion with a mounting axis, said mounting portion being for vertically adjustable mounting of said housing element to an elongated substantially vertical stand element such that said mounting axis is generally parallel to said stand element.

8. A system as defined in claim 7 in which said at least partially inverted orientation is defined along a vial engagement axis, said vial engagement axis being at an orientation angle of greater than 0 degrees with respect to said mounting axis.

9. A system as defined in claim 8 in which said orientation angle is approximately between 5 degrees and 25 degrees.

10. A system as defined in claim 8 in which said orientation angle is readily adjustable.

11. A system as defined in claim 1 further comprising a drip tray and a tray support bracket, said drip tray being removably supportable by said tray support bracket.

12. A system as defined in claim 1 in which said at least partially inverted orientation is defined along a vial engagement axis, said clamp element includes a generally curved clamp wall and said housing element includes a generally curved fixed wall, said clamp wall and said fixed wall each having a respective axis of curvature which is substantially parallel to said vial engagement axis.

13. A system as defined in claim 12 in which said clamp wall includes or more elastomeric gripping elements thereon.

14. A system as defined in claim 12 in which said clamp element includes a handle portion and a spring engagement portion, said handle portion being accessible from outward of said housing element, said clamp element being movable from its clamping configuration to its open configuration by way of a reset force applied to its handle portion, said elastic bias being provided by a clamp spring element connected between said spring engagement portion and said housing element, said clamp wall being disposed generally between said spring engagement portion and said handle portion.

15. A system adapted for capturing and releasably retaining at least one vial of medication in an at least partially inverted orientation wherein the top of said at least one vial remains accessible to a syringe needle, said system comprising:

at least one vial engagement station partially defined by a housing element, said vial engagement station including a clamp element and a latch element and being adapted to receive a vial for releasable retention thereof in said at least partially inverted orientation, said housing element including at least one window portion through which a label of said vial is able to be read from a viewing position outward of the housing element when said vial is in said releasable retension, said housing element further including a mounting portion with a mounting axis, said mounting portion being for vertically adjustable mounting of said housing element to an elongated substantially vertical stand element such that said mounting axis is generally parallel to said stand element, said at least partially inverted orientation being defined along a vial engagement axis, said vial engagement axis being at an orientation angle of greater than 0 degrees with respect to said mounting axis, said clamp element being connected to said housing element for movement between an open configuration and a clamping configuration and being elastically biased toward its clamping configuration, said latch element being movable between a latching configuration and an unlatching configuration and being resiliently biased toward its latching configuration, said latch element including a distal portion and being actuatable toward its unlatching configuration by way of an actuation force applied to said distal portion by way of said vial;

wherein said clamp element is adapted to applying a clamping force to said vial when in its clamping configuration, and relieving said clamping force when moved toward its open configuration; and wherein said latch element is adapted to latchingly restrain said clamp element in said open configuration when said latch element is in its latching configuration, and said latch element is adapted to allowing said clamp element to move from said open configuration toward said clamping configuration when said latch element is in its unlatching configuration.

16. A system as defined in claim 15 in which said orientation angle is approximately between 5 degrees and 25 degrees.

17. A system as defined in claim 15 comprising a multiplicity of said vial engagement stations, all of which are partially defined by the same said housing element.

18. A system for capturing and releasably retaining at least one vial of medication in an at least partially inverted orientation wherein the top of said at least one vial remains accessible to a syringe needle, said system comprising:

at least one vial engagement station partially defined by a housing element, said vial engagement station including a clamp element and a latch element and being configured to receive a vial for releasable retention thereof in said at least partially inverted orientation, said housing element including at least one window portion through which a label of said vial is able to be read from a viewing position outward of the housing element when said vial is in said releasable retention, said housing element further including a mounting portion with a mounting axis, said mounting portion being for vertically adjustable mounting of said housing element to an elongated substantially vertical stand element such that said mounting axis is generally parallel to said stand element, said at least partially inverted orientation being defined along a vial engagement axis, said vial engagement axis being at an orientation angle of approximately between 5 degrees and 25 degrees with respect to said mounting axis, said clamp element including a spring engagement portion, a handle portion and a clamp wall disposed generally therebetween, said handle portion extending generally outward of said housing element, said clamp element being connected to said housing element for movement between an open configuration and a clamping configuration and being elastically biased toward its clamping configuration, said elastic bias being provided by a clamp spring element connected between said spring engagement portion and said housing element, said clamp element being movable from its clamping configuration to its open configuration by way of a reset force applied to its handle portion, said latch element being movable between a latching configuration and an unlatching configuration and being resiliently biased toward its latching configuration, said latch element including a distal portion and being actuatable toward its unlatching configuration by way of an actuation force applied to said distal portion by way of said vial; and a drip tray and a tray support bracket, said drip tray being removably supportable by said tray support bracket, said tray support bracket being vertically adjustably mountable to said stand element;

wherein said clamp element is adapted to applying a clamping force to said vial by way of said clamp wall when in its clamping configuration and said vial is received by said vial engagement station, and said clamp element is adapted to relieving said clamping force when moved toward its open configuration; and wherein said latch element is adapted to latchingly restrain said clamp element in said open configuration upon movement of said clamp element thereto when said latch element is in its latching configuration, and said latch element is adapted to allowing said clamp element to move from said open configuration toward said clamping configuration when said latch element is in its unlatching configuration.

19. A system as defined in claim 18 in which said clamp wall includes a vial engagement face with one or more elastomeric gripping elements thereon, said clamp wall being generally curved, said housing element includes a generally curved fixed wall, and said clamp wall and said fixed wall each have a respective axis of curvature which is substantially parallel to said vial engagement axis.

20. A system as defined in claim 18 in which said system comprises a multiplicity of said vial engagement stations, all of which are partially defined by the same said housing element.

21. A method for using at least one syringe to extract medication from at least one vial without requiring a human hand to grasp said at least one vile during said extraction, said method comprising:

providing a vial engagement station partially defined by a housing element, said vial engagement station including a clamp element and a latch element, said clamp element including a handle portion and being pivotably associated with said housing element for movement between an open configuration and a clamping configuration, said clamp element being elastically biased toward its clamping configuration, said latch element being movable between a latching configuration and an unlatching configuration and being resiliently biased toward its latching configuration, said latch element including a distal portion and being actuatable toward its unlatching configuration by way of an actuation force applied to said distal portion, said latch element being adapted to latchingly restrain said clamp element in said open configuration when said latch element is in its latching configuration, and said latch element being adapted to allowing said clamp element to move from said open configuration toward said clamping configuration when said latch element is in its unlatching configuration;

choosing a vial containing a selected medication;

transporting said vial to said vial engagement station;

at least partially inverting said vial;

upwardly inserting said vial into said vial engagement station such that said vial applies said actuation force, resulting in movement of said clamp element to its clamping configuration wherein it applies a clamping force to said vial, said vial engagement station thereby releasably retaining said vial in an at least partially inverted orientation wherein the top of said vial remains accessible to a syringe needle of said syringe;

reading a label of said vial from a viewing position outward of said housing element to verify said vial contains said selected medication;

puncturing said top of said vial with said syringe needle;

extracting at least a volume of said selected medication into said syringe;

removing said syringe needle from said vial; and applying a reset force to said handle portion, thereby causing said clamp element to move to its open configuration such that said latch element latches said clamp element in its open configuration.

22. A method as defined in claim 21 in which said housing element includes a window portion disposed between said label and said viewing position.

23. A method as defined in claim 21 comprising providing a multiplicity of said vial engagement stations, respective said vials and respective said syringes, wherein said vial engagement stations are partially defined by the same said housing element, and in which the steps of choosing, transporting, at least partially inverting, upwardly inserting and reading are performed for each respective said vial.

24. A method as defined in claim 21 in which said at least partially inverted orientation is defined along a vial engagement axis, said vial engagement axis being at an orientation angle of greater than 0 degrees with respect to a local horizontal surface.

* * * * *